US009953753B2

(12) United States Patent
Moon

(10) Patent No.: US 9,953,753 B2
(45) Date of Patent: Apr. 24, 2018

(54) ELECTRONIC COMPONENT

(71) Applicant: SAMSUNG ELECTRO-MECHANICS CO., LTD., Suwon-Si, Gyeonggi-Do (KR)

(72) Inventor: Byeong Cheol Moon, Suwon-Si (KR)

(73) Assignee: SAMSUNG ELECTRO-MECHANICS CO., LTD., Suwon-si, Gyeonggi-Do (KR)

( * ) Notice: Subject to any disclaimer, the term of this patent is extended or adjusted under 35 U.S.C. 154(b) by 0 days.

(21) Appl. No.: 14/934,065

(22) Filed: Nov. 5, 2015

(65) Prior Publication Data

US 2016/0163438 A1 Jun. 9, 2016

(30) Foreign Application Priority Data

Dec. 8, 2014 (KR) ..... 10-2014-0175017

(51) Int. Cl.

| | |
|---|---|
| ***H01F 5/00*** | (2006.01) |
| ***H01F 27/24*** | (2006.01) |
| ***H01F 3/10*** | (2006.01) |
| ***H01F 3/06*** | (2006.01) |
| ***H01F 17/00*** | (2006.01) |
| ***H01F 27/29*** | (2006.01) |

(52) U.S. Cl.

CPC ..... *H01F 3/10* (2013.01); *H01F 3/06* (2013.01); *H01F 17/0013* (2013.01); *H01F 27/292* (2013.01); *H01F 2003/106* (2013.01)

(58) Field of Classification Search

CPC ..... H01F 3/10; H01F 3/06; H01F 3/08; H01F 2003/106; H01F 17/0013; H01F 27/292; H01F 27/255

USPC ..... 336/212, 200, 233

See application file for complete search history.

(56) References Cited

U.S. PATENT DOCUMENTS

| | | | | |
|---|---|---|---|---|
| 2009/0002117 | A1* | 1/2009 | Kawarai | H01F 17/0006 336/233 |
| 2010/0308949 | A1* | 12/2010 | Lim | H01F 17/04 336/218 |
| 2012/0188049 | A1* | 7/2012 | Matsuura | B22F 1/02 336/212 |
| 2012/0274437 | A1* | 11/2012 | Matsuura | H01F 1/14783 336/221 |
| 2013/0127576 | A1* | 5/2013 | Hachiya | H01F 27/255 336/200 |
| 2013/0249662 | A1 | 9/2013 | Tonoyama et al. | |

FOREIGN PATENT DOCUMENTS

| | | |
|---|---|---|
| JP | 11-204337 A | 7/1999 |
| JP | 2013-201374 A | 10/2013 |
| KR | 10-0888437 B1 | 3/2009 |

* cited by examiner

*Primary Examiner* — Mangtin Lian

(74) *Attorney, Agent, or Firm* — McDermott Will & Emery LLP

(57) ABSTRACT

An electronic component includes a magnetic body having internal coil patterns. The magnetic body includes a core part including the internal coil patterns; and upper and lower cover parts disposed above and below the core part, respectively. Magnetic wires are disposed in the core part, and magnetic plates are disposed in the upper and lower cover parts.

5 Claims, 6 Drawing Sheets

ELECTRONIC COMPONENT

CROSS-REFERENCE TO RELATED APPLICATION

This application claims the benefit of priority to Korean Patent Application No. 10-2014-0175017, filed on Dec. 8, 2014 with the Korean Intellectual Property Office, the entirety of which is incorporated herein by reference.

TECHNICAL FIELD

The present disclosure relates to an electronic component and a board having the same.

BACKGROUND

An inductor, an electronic component, is a representative passive element configuring an electronic circuit, together with a resistor and a capacitor, to remove noise. The inductor is combined with the capacitor using electromagnetic properties to configure a resonance circuit amplifying a signal in a specific frequency band, a filter circuit, or the like.

As information technology (IT) devices, such as various communications devices, display devices, or the like, have been rapidly miniaturized, research into a technology for miniaturizing and thinning various elements, such as inductors, capacitors, transistors and the like, that are used in these IT devices has been continuously conducted. Accordingly, the inductor has also been rapidly replaced by a chip having a small size and a high density and capable of being automatically surface-mounted, and a thin film type inductor in which a mixture of magnetic powder and a resin is provided on coil patterns formed on upper and lower surfaces of a thin film insulating substrate by plating has been developed.

The thin film type inductor is manufactured by forming the coil patterns on the insulating substrate and then filling an outer portion of the insulating substrate with a magnetic material.

In accordance with the development of portable devices such as smartphones, tablet personal computers (PCs), and the like, the use of a dual-core or quad-core advanced processing unit (APU) having high speed and a wide display has increased. However, existing ferrite inductors may not provide a sufficiently rated current required for dual-core or quad-core APUs and wide displays.

Therefore, metal-composite inductors in which metal powder having good direct current (DC)-bias characteristics is mixed with an organic material have been mainly released over the past two to three years.

Because metal generally has a large eddy loss in alternating current (AC), it is not generally used in a high frequency band. However, a composite may be manufactured by turning the metal into powder having a small particle size. Insulating surfaces of the powder have small particle size, and mixing the powder having the small particle size with an organic material decreases eddy loss. Therefore, the composite may be used even in a frequency band of 1 MHz or more.

However, one problem associated with the above-mentioned insulation processing is that an insulating layer preventing electricity from being conducted hinders a flow of magnetic flux, and thus high magnetic permittivity may not be obtained.

SUMMARY

An aspect of the present disclosure provides an electronic component and a board having the same.

According to an aspect of the present disclosure, an electronic component includes a magnetic body having internal coil patterns. The magnetic body includes a core part including the internal coil patterns; and upper and lower cover parts disposed above and below the core part, respectively. Magnetic wires are disposed in the core part, and magnetic plates are disposed in the upper and lower cover parts.

The magnetic wires may be disposed to be perpendicular to a mounting surface of the magnetic body.

The magnetic plates may be disposed to be parallel to a mounting surface of the magnetic body.

The magnetic wires may contain a magnetic powder and may be coated with an insulating material.

The electronic component may further comprise insulating layers disposed on outer surfaces of the upper and lower cover parts.

The magnetic plates may comprise assemblies of fragments fractured by discontinuously formed cracks The magnetic powder may include magnetic particles having different sizes.

According to another aspect of the present disclosure, an electronic component includes a magnetic body having internal coil patterns. The magnetic body includes a core part including the internal coil patterns, and upper and lower cover parts disposed on upper and lower portions of the core part, respectively. The core part includes magnetic wires disposed therein, and the upper and lower cover parts include a magnetic powder provided therein.

According to another aspect of the present disclosure, a board having an electronic component includes a printed circuit board having first and second electrode pads disposed thereon, and the electronic component installed on the printed circuit board.

BRIEF DESCRIPTION OF DRAWINGS

The above and other aspects, features and advantages of the present disclosure will be more clearly understood from the following detailed description taken in conjunction with the accompanying drawings.

DETAILED DESCRIPTION

Figure 1:
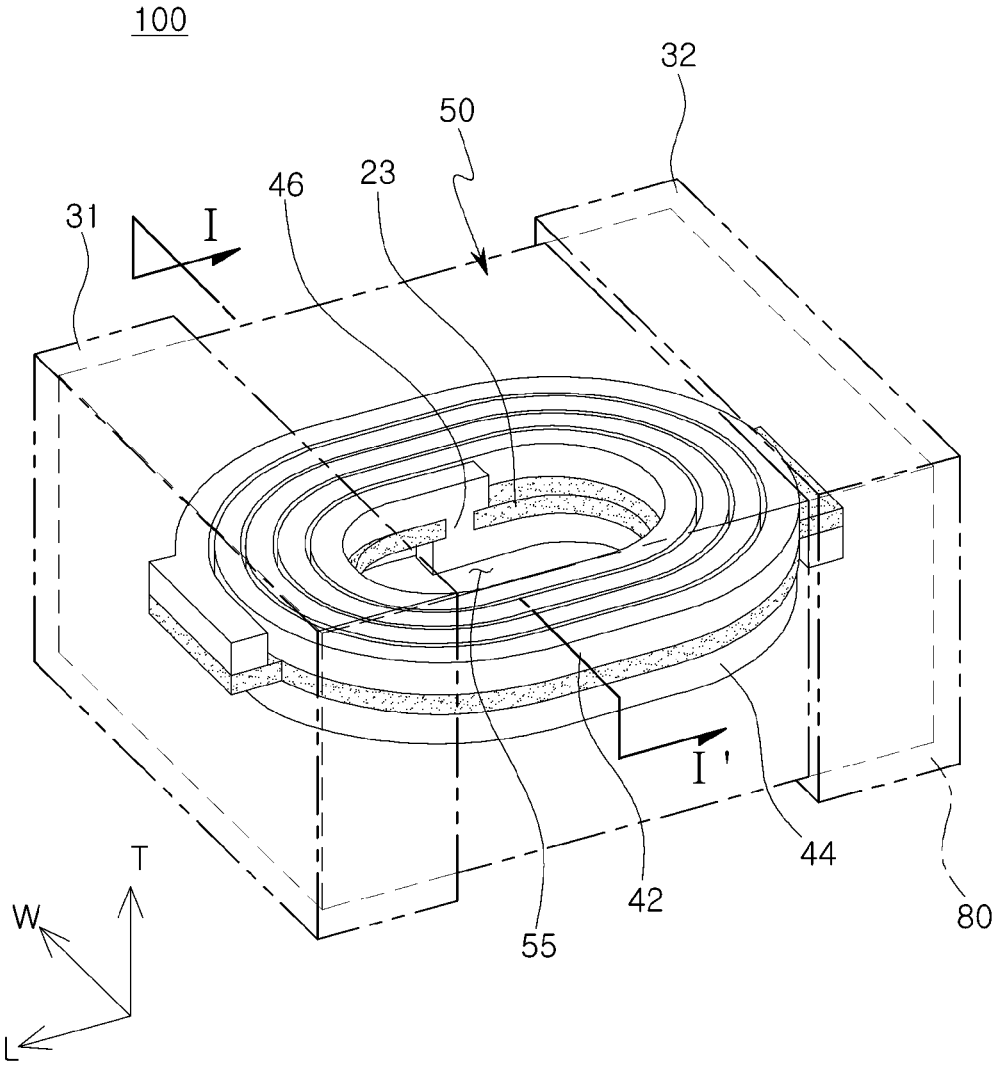
FIG. 1 is a schematic perspective view of an electronic component according to an exemplary embodiment in the present disclosure so that internal coil patterns of the electronic component are visible.

Hereinafter, embodiments of the present disclosure will be described in detail with reference to the accompanying drawings.

The disclosure may, however, be embodied in many different forms and should not be construed as being limited to the embodiments set forth herein. Rather, these embodiments are provided so that this disclosure will be thorough and complete, and will fully convey the scope of the disclosure to those skilled in the art.

In the drawings, the shapes and dimensions of elements may be exaggerated for clarity, and the same reference numerals will be used throughout to designate the same or like elements.

Electronic Component

Hereinafter, an electronic component according to an exemplary embodiment, in particular, a thin film type inductor, will be described. However, the electronic component is not limited thereto.

FIG. 1 is a schematic perspective view illustrating an electronic component so that internal coil patterns of the electronic component are visible.

Figure 2:
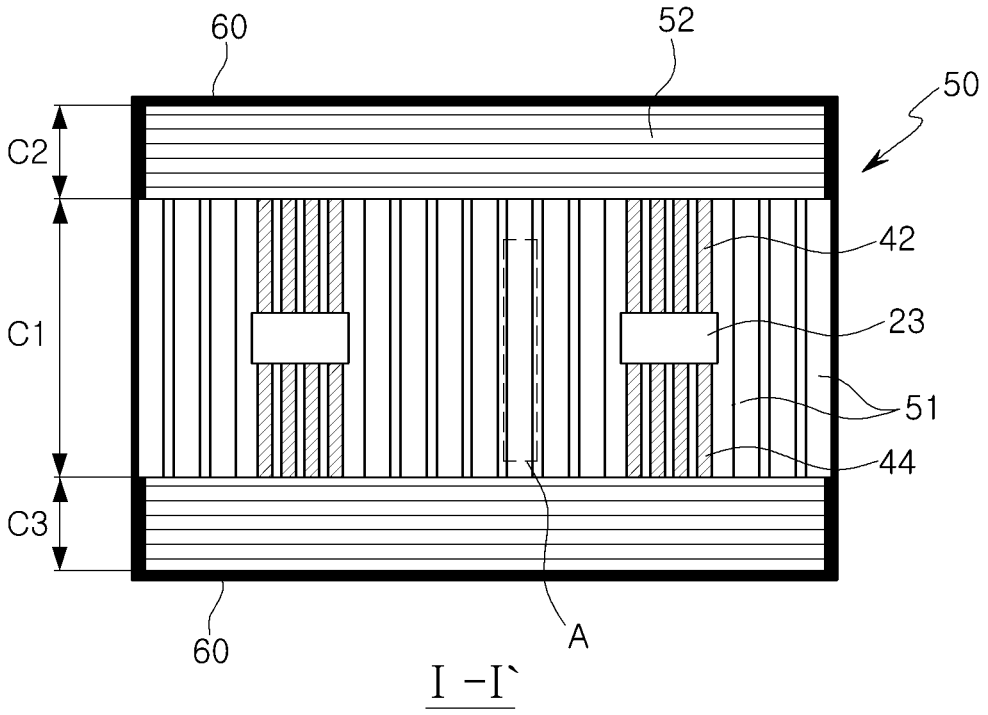
FIG. 2 is a cross-sectional view taken along line I-I' of FIG. 1.

FIG. 2 is a cross-sectional view taken along line I-I' of FIG. 1.

Figure 3:
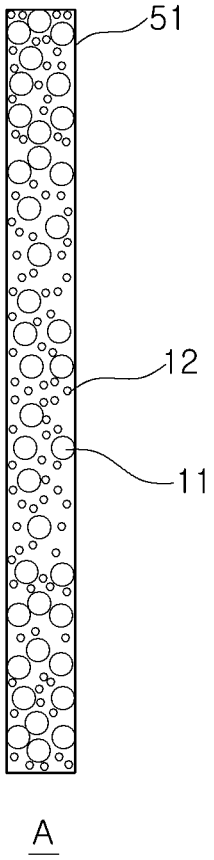
FIG. 3 is an enlarged schematic view of part A of FIG. 2.

FIG. 3 is an enlarged schematic view of part A of FIG. 2.

Referring to FIGS. 1 through 3, a thin film type inductor 100 used in a power line of a power supplying circuit is provided as an example of an electronic component. The electronic component may be appropriately applied as a bead, a filter, or the like.

In addition, hereinafter, although the thin film type inductor will be described as an example of the electronic component, the electronic component is not necessarily limited thereto, and may be, for example, a rectangular winding type electronic component, an edge-wise winding type electronic component, or a metal mold winding type electronic component.

The thin film type inductor 100 may include a magnetic body 50, an insulating substrate 23, and internal coil patterns 42 and 44.

The thin film type inductor 100 may be manufactured by forming the internal coil patterns 42 and 44 on the insulating substrate 23 and then filling an outer portion of the magnetic body 50 with a magnetic material.

In an insulating substrate plating operation of forming the internal coil patterns 42 and 44 of the inductor, an insulating material such as a solder resist (SR), a dry film resist (DFR), or the like, may be applied to a specific portion of the coil to perform secondary plating, after a primary pattern plating operation.

A pattern plating layer may be formed by the primary pattern plating operation. In this operation, a photo-resist resin may be applied onto the insulating substrate, and coil patterns may be exposed, transferred, and developed by a photo mask to allow the photo-resist to remain at a portion at which light does not arrive. In this state, when plating is performed and the remaining photo-resist is removed, the pattern plating layer may be formed.

After the primary pattern plating operation, the secondary plating may be performed on the insulating substrate to grow the pattern plating layer, thereby disposing the internal coil patterns 42 and 44 on upper and lower surfaces of the insulating substrate 23, respectively.

A general thin film type inductor may require high inductance (L) and low direct current (DC) resistance (Rdc) and may be mainly used particularly in a case in which a deviation between inductance values in each frequency needs to be low.

The shape of the magnetic body 50 may form the shape of the thin film type inductor 100, and may be formed of any material that exhibits magnetic properties. For example, the magnetic body 50 may be formed by providing ferrite or a metal based soft magnetic material.

The magnetic body 50 may have a hexahedral shape. Directions of a hexahedron will be defined in order to clearly describe an exemplary embodiment. "L," "W," and "T" illustrated in FIG. 1 refer to a length direction, a width direction, and a thickness direction, respectively.

The magnetic body 50 may include a core part C1 including the internal coil patterns 42 and 44 and upper and lower cover parts C2 and C3 disposed on upper and lower portions of the core part C1, respectively.

The insulating substrate 23 formed in the magnetic body 50 may be formed of a thin film, and may be formed of any material that may form the internal coil patterns 42 and 44 by plating. The insulating substrate 23 may be, for example, a printed circuit board (PCB), a ferrite substrate, a metal based soft magnetic substrate, or the like.

The insulating substrate 23 may have a hole formed in a central portion thereof to penetrate therethrough, wherein the hole may be filled with a magnetic material such as ferrite, a metal based soft magnetic material, or the like, to thereby form a core part. The core part filled with the magnetic material may be formed, thereby increasing inductance (L).

The insulating substrate 23 may have the internal coil patterns 42 and 44 formed on first and second surfaces thereof, respectively, wherein the internal coil patterns 42 and 44 have coil shaped patterns, respectively.

The internal coil patterns 42 and 44 may include coil patterns having a spiral shape, and the internal coil patterns 42 and 44 formed on the first and second surface of the insulating substrate 23, respectively, may be electrically connected to each other through a via electrode 46 formed in the insulating substrate 23.

The internal coil patterns 42 and 44 and the via electrode may be formed of a metal having excellent electrical conductivity, such as silver (Ag), palladium (Pd), aluminum (Al), nickel (Ni), titanium (Ti), gold (Au), copper (Cu), platinum (Pt), or alloys thereof.

Although not illustrated in the accompanying drawings, an insulating film may be formed on surfaces of the internal coil patterns 42 and 44. The insulating film may be formed by a method well-known in the art such as a screen printing method, an exposure and development method of a photo-resist (PR), a spray applying method, a dipping method, or the like. The insulating film may be formed of any material that may form a thin film, such as a photo-resist (PR) or an epoxy based resin.

One end portion of the internal coil pattern 42 formed on one surface of the insulating substrate 23 may be exposed to one end surface of the magnetic body 50 in the length direction, and one end portion of the internal coil pattern 44 formed on the other surface of the insulating substrate 23 may be exposed to the opposite end surface of the magnetic body 50 in the length direction.

External electrodes 31 and 32 may be formed on opposite end surfaces of the magnetic body 50 in the length direction, respectively, to be connected to the internal coil patterns 42 and 44 exposed to both end surfaces of the magnetic body 50 in the length direction, respectively.

The external electrodes 31 and 32 may extend to both side surfaces of the magnetic body 50 in the thickness direction and/or both side surfaces of the magnetic body 50 in the width direction.

In addition, the external electrodes 31 and 32 may be formed on a lower surface of the magnetic body 50 and may extend to both end surfaces of the magnetic body 50 in the length direction. For instance, the external electrodes 31 and 32 are not limited to being disposed in a particular form, and may be disposed in various forms.

The external electrodes 31 and 32 may be formed of a metal having excellent electrical conductivity, such as nickel (Ni), copper (Cu), tin (Sn), silver (Ag), or alloys thereof.

Referring to FIG. 1, the internal coil patterns may be disposed to be in parallel with the lower surface of the magnetic body, but are not limited thereto. For instance, the internal coil patterns may be disposed to be perpendicular to the lower surface of the magnetic body.

According to an exemplary embodiment, magnetic wires 51 may be disposed in the core part C1, and magnetic plates 52 may be disposed in the upper and lower cover parts C2 and C3. The magnetic wires 51 may be disposed to be perpendicular to a mounting surface of the magnetic body 50, and the magnetic plates 52 may be disposed to be in parallel with the mounting surface of the magnetic body 50.

A composite may be manufactured by turning the metal into a powder having a small particle size, insulating surfaces of the powder having the small particle size, and mixing the powder having the small particle size with an organic material to decrease the above-mentioned problem and an eddy loss problem. However, due to the above-mentioned insulation processing, an insulating layer preventing electricity from being conducted hinders a flow of a magnetic flux, and thus high magnetic permittivity may not be obtained.

However, according to an exemplary embodiment, the magnetic wires 51 may be disposed in the core part C1 to be perpendicular to the mounting surface of the magnetic body 50, and the magnetic plates 52 may be disposed in the upper and lower cover parts C2 and C3 to be in parallel with the mounting surface of the magnetic body 50, and thus the hindrance of the flow of the magnetic flux may be significantly decreased, and eddy loss may be significantly decreased, thereby implementing a high-inductance small inductor.

For instance, when the thin film type inductor 100 is driven, an internal magnetic flux may flow in the thickness direction of the magnetic body in the core part C1, and flow in a direction that is in parallel with the surface of the magnetic body in the upper and lower cover parts C2 and C3.

Therefore, the magnetic wires 51 may be disposed in the core part C1 to be perpendicular to the mounting surface of the magnetic body 50, and the magnetic plates 52 may be disposed in the upper and lower cover parts C2 and C3 to be in parallel with the mounting surface of the magnetic body 50, and thus the flow of an internal magnetic flux and disposition of magnetic materials may coincide with each other as much as possible. As a result, the flow of the magnetic flux may not be hindered.

In addition, in order to dispose the magnetic materials to be perpendicular to the mounting surface of the magnetic body 50, the magnetic wires 51 may be disposed in the core part C1.

Referring to FIG. 3, the magnetic wires 51 may be formed by magnetic powders 11 and 12 and coated with an insulating material. The magnetic wire 51 may be formed by providing the magnetic powders 11 and 12, which are ferrite materials or metal based soft magnetic materials.

As the ferrite, an Mn—Zn based ferrite, an Ni—Zn based ferrite, an Ni—Zn—Cu based ferrite, an Mn—Mg based ferrite, a Ba based ferrite, an Li based ferrite, or the like, may be used.

The metal based soft magnetic material may be an alloy containing one or more selected from the group consisting of iron (Fe), silicon (Si), chromium (Cr), aluminum (Al), and nickel (Ni). For example, the metal based soft magnetic material may contain Fe—Si—B—Cr based amorphous metal particles and nanocrystalline materials, but is not limited thereto.

The metal based soft magnetic material may have a particle size of 0.1 μm to 30 μm, and the magnetic powders 11 and 12 may be two or more powders having different particle sizes.

When the magnetic powders 11 and 12 are the two or more powders having the different particle sizes as described above, a packing factor of the magnetic powders provided in the magnetic wires 51 may be increased, and thus magnetic permittivity may be further improved.

Conversely, the magnetic flux may be diffused in parallel with the surface of the magnetic body in the upper and lower cover parts C2 and C3. Thus, it may be difficult to arrange the magnetic wires in the upper and lower cover parts C2 and C3.

Therefore, the magnetic plates 52 may be disposed in the upper and lower cover parts C2 and C3, and thus a structure coinciding with the flow of the magnetic flux as much as possible may be implemented.

Since the above-mentioned magnetic plate 52 has a cross-sectional area larger than that of the magnetic wire, a plurality of plates implemented to be as thin as possible may be stacked.

The magnetic plate 52 may be formed of a ferrite material or a metal based soft magnetic material.

As the ferrite, an Mn—Zn based ferrite, an Ni—Zn based ferrite, an Ni—Zn—Cu based ferrite, an Mn—Mg based ferrite, a Ba based ferrite, an Li based ferrite, or the like, may be used.

The metal based soft magnetic material may be an alloy containing one or more selected from the group consisting of iron (Fe), silicon (Si), chromium (Cr), aluminum (Al), and nickel (Ni). For example, the metal based soft magnetic material may contain Fe—Si—B—Cr based amorphous metal particles and nanocrystalline materials, but is not limited thereto.

When the magnetic plate 52 is formed of a single plate, there may be an advantage in that magnetic permittivity may be very large. A high voltage, however, may be instantaneously applied to external terminals of the entire electronic component. In that case, a problem may occur in withstand voltage characteristics.

According to an exemplary embodiment, insulating layers 60 may be further disposed on outer surfaces of the upper and lower cover parts C2 and C3, respectively.

As described above, the insulating layers 60 may be further disposed on the outer surfaces of the upper and lower cover parts C2 and C3, respectively, and thus the electronic component may exhibit excellent withstand voltage characteristics.

Figure 4:
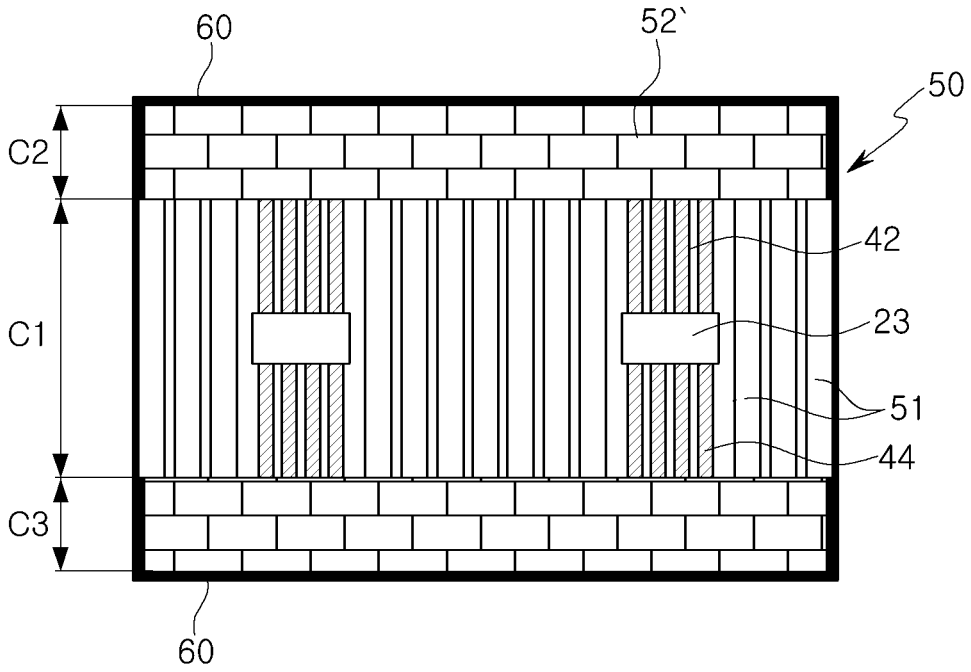
FIG. 4 is a cross-sectional view of an electronic component according to another exemplary embodiment in the present disclosure taken along line I-I' of FIG. 1.

FIG. 4 is a cross-sectional view of an electronic component according to another exemplary embodiment taken along line I-I' of FIG. 1.

Referring to FIG. 4, the electronic component, according to another exemplary embodiment, may be different from the electronic component according to the exemplary embodiment described above in that magnetic plates 52' disposed in the upper and lower cover parts C2 and C3 have a form of assemblies of fragments fractured by discontinuously formed cracks.

As described above, the magnetic plates 52' may be disposed in the form of the assemblies of the fragments fractured by the discontinuously formed cracks in the upper and lower cover parts C2 and C3, thereby enhancing an insulation property of the cover parts.

In addition, core loss may be decreased, and thus a quality (Q) factor of the electronic component may be improved.

Figure 5:
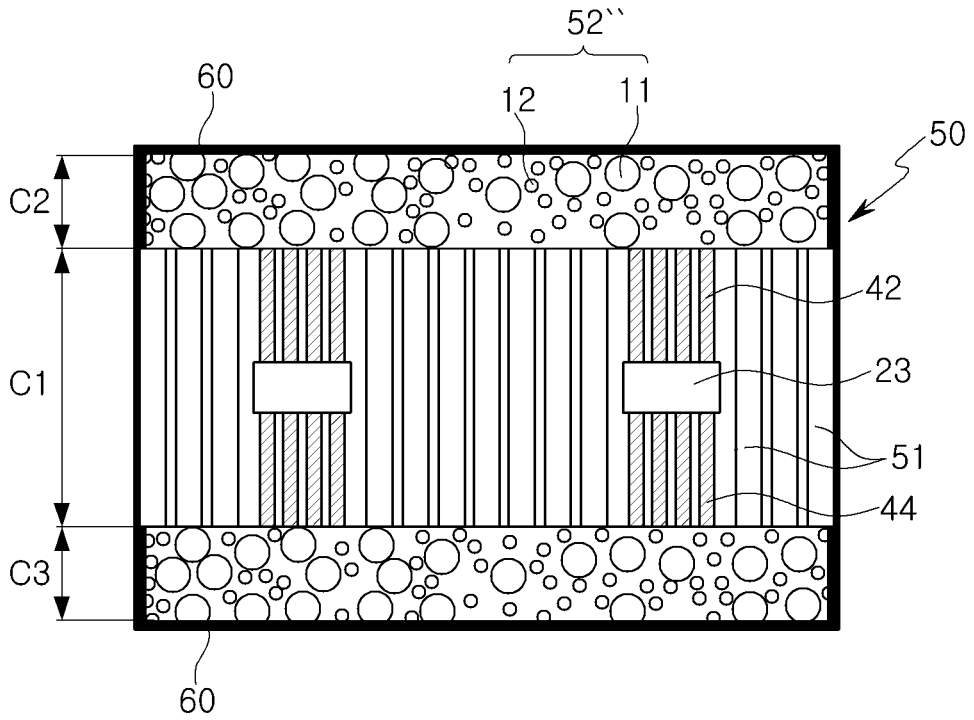
FIG. 5 is a cross-sectional view of an electronic component according to another exemplary embodiment in the present disclosure taken along line I-I' of FIG. 1.

FIG. 5 is a cross-sectional view of an electronic component according to another exemplary embodiment taken along line I-I' of FIG. 1.

Referring to FIG. 5, in the electronic component, according to another exemplary embodiment, in the magnetic body 50 including the core part C1 including the internal coil patterns 42 and 44 and the upper and lower cover parts C2 and C3 disposed on the upper and lower portions of the core part C1, respectively, the magnetic wires 51 may be disposed in the core part C1 and magnetic powder 52" may be provided in the upper and lower cover parts C2 and C3.

As described above, the magnetic powder 52" may be provided in the upper and lower cover parts C2 and C3, thereby enhancing an insulation property of the cover parts.

The magnetic powder 52" is not particularly limited, but may be, for example, two or more magnetic powders 11 and 12 having different particle sizes.

When the magnetic powder 52" is made up of magnetic particles having different sizes, as described above, packing factors of the magnetic powder provided in the upper and lower cover parts C2 and C3 may be increased, and thus magnetic permittivity may be further improved.

Next, a process of manufacturing an electronic component according to an exemplary embodiment will be described.

First, the internal coil patterns 42 and 44 may be formed on the insulating substrate 23.

The internal coil patterns 42 and 44 may be formed on the insulating substrate 23 formed of a thin film by an electroplating method, or the like. Here, the insulating substrate 23 is not particularly limited, but may be, for example, a printed circuit board (PCB), a ferrite substrate, a metal based soft magnetic substrate, or the like, and may have a thickness of 40 μm to 100 μm.

A method of forming the internal coil patterns 42 and 44 may be, for example, an electroplating method, but is not limited thereto. The internal coil patterns 42 and 44 may be formed of a metal having excellent electrical conductivity, such as silver (Ag), palladium (Pd), aluminum (Al), nickel (Ni), titanium (Ti), gold (Au), copper (Cu), platinum (Pt), or alloys thereof.

The hole may be formed in a portion of the insulating substrate 23 and may be filled with a conductive material to form the via electrode 46, and the internal coil patterns 42 and 44 formed on the first and second surfaces of the insulating substrate 23, respectively, may be electrically connected to each other through the via electrode 46.

Drilling, laser processing, sandblasting, punching, or the like, may be performed on a central portion of the insulating substrate 23 to form the hole penetrating through the insulating substrate 23.

The internal coil patterns 42 and 44 may be formed by forming electroplated layers on the pattern plating layers formed by a printing method, by secondary lead wire plating.

Next, the magnetic powder may be formed into magnetic wires and the magnetic wires coated with the insulating material to manufacture the magnetic wires, and the magnetic wires may be disposed at inner and outer sides of the internal coil patterns 42 and 44.

Next, a plurality of magnetic plates may be stacked on and beneath the internal coil patterns 42 and 44 in a state in which the internal coil patterns 42 and 44 and the magnetic wires are disposed, thereby forming the magnetic body 50.

In addition, the external electrodes 31 and 32 connected to the internal coil patterns 42 and 44 exposed to the end surfaces of the magnetic body 50 may be formed.

The external electrodes 31 and 32 may be formed of a paste containing a metal having excellent electrical conductivity, such as a conductive paste containing nickel (Ni), copper (Cu), tin (Sn), or silver (Ag), or alloys thereof. The external electrodes 31 and 32 may be formed by a dipping method, or the like, as well as a printing method depending on a shape thereof.

A description of features that are the same as those of the electronic component according to the exemplary embodiment described above will be omitted.

Board Having Electronic Component

Figure 6:
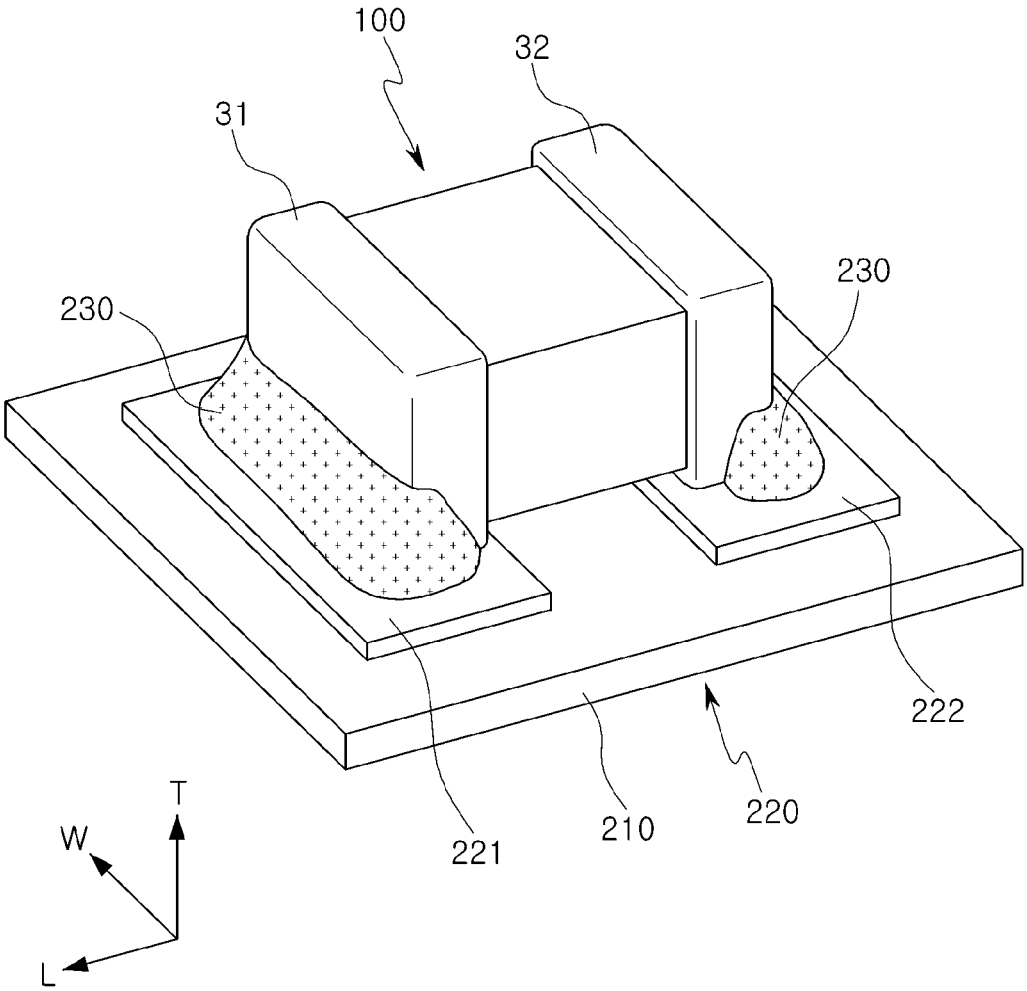
FIG. 6 is a perspective view of a board in which the electronic component of FIG. 1 is mounted on a printed circuit board.

FIG. 6 is a perspective view of a board in which the electronic component of FIG. 1 is mounted on a printed circuit board.

Referring to FIG. 6, a board 200 having an electronic component 100 according to the present exemplary embodiment may include a printed circuit board 210 on which the electronic component 100 is mounted to be in parallel therewith, and first and second electrode pads 221 and 222 formed on an upper surface of the printed circuit board 210 spaced apart from each other.

Here, the first and second external electrodes 31 and 32 of the electronic component 100 may be electrically connected to the printed circuit board 210 by solders 230 in a state in which they are positioned on the first and second electrode pads 221 and 222, respectively, to contact the first and second electrode pads 221 and 222, respectively.

A description of features overlapping those of the electronic component according to the exemplary embodiment described above except for the above-mentioned description will be omitted.

As set forth above, according to exemplary embodiments, a hindrance of the flow of the magnetic flux may be significantly decreased, and eddy loss may be significantly decreased, thereby implementing a high-inductance small inductor.

In addition, the insulation on the outer surfaces of the upper and lower cover parts of the electronic component may be enhanced, and thus the electronic component may exhibit excellent withstand voltage characteristics.

While exemplary embodiments have been shown and described above, it will be apparent to those skilled in the art that modifications and variations could be made without departing from the scope of the present invention as defined by the appended claims.

What is claimed is:

1. An electronic component comprising:

a magnetic body having internal coil patterns, wherein the magnetic body includes:

a core part including the internal coil patterns; and upper and lower cover parts disposed above and below the core part, respectively, and magnetic wires disposed in the core part, and magnetic plates disposed in the upper and lower cover parts, wherein each magnetic wire contains a plurality of magnetic powder particles having at least two different particle sizes and is coated with an insulating material, the magnetic wires are disposed to be perpendicular to a mounting surface of the magnetic body, and the insulating material of each magnetic wire extends substantially linearly from the lower cover part to the upper cover part to coat the magnetic wire containing magnetic powder particles having the different particle sizes.

2. The electronic component of claim 1, wherein the magnetic plates are disposed to be parallel to a mounting surface of the magnetic body.

3. The electronic component of claim 1, further comprising insulating layers disposed on outer surfaces of the upper and lower cover parts.

4. The electronic component of claim 1, wherein the magnetic plates comprise assemblies of fragments fractured by discontinuously formed cracks.

5. An electronic component comprising:

a magnetic body having internal coil patterns, wherein the magnetic body includes:

a core part including the internal coil patterns; and upper and lower cover parts disposed above and below the core part, respectively, and the core part including magnetic wires disposed therein, and the upper and lower cover parts including a magnetic powder provided therein, wherein each magnetic wire contains a plurality of magnetic powder particles having at least two different particle sizes and is coated with an insulating material, the magnetic wires are disposed to be perpendicular to a mounting surface of the magnetic body, and the insulating material of each magnetic wire extends substantially linearly from the lower cover part to the upper cover part to coat the magnetic wire containing magnetic powder particles having the different particle sizes.

* * * * *